US009201329B2

(12) United States Patent
Aga et al.

(10) Patent No.: US 9,201,329 B2
(45) Date of Patent: Dec. 1, 2015

(54) POROUS FERRITE CORE MATERIAL FOR ELECTROPHOTOGRAPHIC DEVELOPER, RESIN-COATED FERRITE CARRIER AND ELECTROPHOTOGRAPHIC DEVELOPER USING THE FERRITE CARRIER

(71) Applicant: Powdertech Co., Ltd., Chiba (JP)

(72) Inventors: Koji Aga, Chiba (JP); Makoto Ishikawa, Chiba (JP); Masashi Aoki, Chiba (JP)

(73) Assignee: POWDERTECH CO., LTD., Chiba (JP)

( * ) Notice: Subject to any disclaimer, the term of this patent is extended or adjusted under 35 U.S.C. 154(b) by 0 days.

(21) Appl. No.: 13/738,324

(22) Filed: Jan. 10, 2013

(65) Prior Publication Data

US 2013/0183614 A1 Jul. 18, 2013

(30) Foreign Application Priority Data

Jan. 13, 2012 (JP) ..... 2012-005402

(51) Int. Cl.
*G03G 9/10* (2006.01)
*G03G 9/107* (2006.01)

(52) U.S. Cl.
CPC ..... *G03G 9/1075* (2013.01); *G03G 9/107* (2013.01)

(58) Field of Classification Search
CPC ..... G03G 9/0821; G03G 9/08797; G03G 9/0819; G03G 9/107; G03G 9/0823; G03G 9/0835
USPC ..... 430/111.4, 111.41
See application file for complete search history.

(56) References Cited

U.S. PATENT DOCUMENTS

| | | | | |
|---|---|---|---|---|
| 2006/0269862 | A1 | 11/2006 | Kobayashi et al. | |
| 2007/0154833 | A1 | 7/2007 | Kayamoto et al. | |
| 2007/0231731 | A1* | 10/2007 | Suwa et al. | 430/111.33 |
| 2008/0199800 | A1* | 8/2008 | Kobayashi et al. | 430/111.31 |
| 2008/0241726 | A1* | 10/2008 | Kobayashi et al. | 430/109.1 |
| 2009/0170022 | A1* | 7/2009 | Kojima et al. | 430/111.1 |
| 2009/0176170 | A1* | 7/2009 | Sugiura et al. | 430/111.31 |
| 2009/0246526 | A1 | 10/2009 | Sugiura et al. | |
| 2010/0196818 | A1* | 8/2010 | Kojima et al. | 430/111.32 |
| 2010/0279221 | A1* | 11/2010 | Wada et al. | 430/105 |
| 2011/0013948 | A1 | 1/2011 | Aga et al. | |
| 2011/0129772 | A1 | 6/2011 | Iwata et al. | |
| 2011/0195357 | A1 | 8/2011 | Sugiura et al. | |
| 2011/0212399 | A1 | 9/2011 | Suwa et al. | |
| 2012/0003579 | A1* | 1/2012 | Iwata et al. | 430/111.32 |

FOREIGN PATENT DOCUMENTS

| | | |
|---|---|---|
| EP | 2267550 | 12/2010 |
| JP | H05-040367 | 2/1993 |
| JP | 2006337579 | 12/2006 |
| JP | 2007-086721 | 4/2007 |
| JP | 2007133100 | 5/2007 |
| JP | 2009175666 | 8/2009 |
| JP | 2009-234839 | 10/2009 |
| JP | 2009244572 | 10/2009 |
| JP | 2010-243798 | 10/2010 |
| JP | 2011-112960 | 6/2011 |
| JP | 2011-150253 | 8/2011 |
| JP | 2011-164225 | 8/2011 |
| WO | WO2005062132 | 7/2005 |

OTHER PUBLICATIONS

Search report from E.P.O., mail date is Apr. 10, 2013.
Office Action issued in Japan Counterpart Patent Appl. No. JP2012-005402, dated Jul. 22, 2015, along with an English translation thereof.

* cited by examiner

*Primary Examiner* — Hoa V Le
(74) *Attorney, Agent, or Firm* — Greenblum & Bernstein, P.L.C.

(57) ABSTRACT

A porous ferrite core material for an electrophotographic developer wherein the apparent density thereof is 1.5 to 1.9 g/cm$^3$, the shape factor SF-2 thereof is 101 to 110 and the magnetization as measured with a VSM at 1K·1000/4π·A/m is 40 to 60 Am$^2$/kg, a resin-coated ferrite carrier for an electrophotographic developer obtained by coating the surface of the porous ferrite core material with a resin, and an electrophotographic developer using the ferrite carrier.

8 Claims, No Drawings

POROUS FERRITE CORE MATERIAL FOR ELECTROPHOTOGRAPHIC DEVELOPER, RESIN-COATED FERRITE CARRIER AND ELECTROPHOTOGRAPHIC DEVELOPER USING THE FERRITE CARRIER

BACKGROUND OF THE INVENTION

1. Field of the Invention

The present invention relates to a porous ferrite core material for an electrophotographic developer used in a two-component electrophotographic developer used in copiers, printers and the like, a resin-coated ferrite carrier and an electrophotographic developer using the resin-coated ferrite carrier.

2. Description of the Related Art

An electrophotographic development method conducts development by adhering toner particles in a developer to an electrostatic latent image formed on a photoreceptor. The developers used in such a method are classified into two-component developers composed of toner particles and carrier particles and one-component developers using only toner particles.

As the development methods using two-component developers composed of toner particles and carrier particles among such developers, a cascade method and the like have long been adopted; currently, however, magnetic brush methods using a magnet roll are predominant.

In a two-component developer, the carrier particles serve as a carrying substance to form a toner image on the photoreceptor in such a way that the carrier particles are stirred together with the toner particles in a developer box filled with the developer to impart a desired charge to the toner particles, and further, convey the thus charged toner particles to the surface of the photoreceptor to form the toner image on the photoreceptor. The carrier particles remaining on a development roll which holds a magnet again return from the development roll to the developer box to be mixed and stirred with the fresh toner particles to be repeatedly used for a predetermined period of time.

In contrast to a one-component developer, a two-component developer is such that the carrier particles are mixed and stirred with the toner particles, thus charge the toner particles, and further have a function to convey the toner particles, and a two-component developer is excellent in the controllability in designing developers. Accordingly, two-component developers are suitable for apparatuses such as full-color development apparatuses required to offer high image quality and high-speed printing apparatuses required to be satisfactory in the reliability and durability in image maintenance.

In two-component developers used in the above-described manner, the image properties such as the image density, fogging, white spot, gradation and resolution are each required to exhibit a predetermined value from the initial stage, and further these properties are required to be invariant and to be stably maintained during the endurance printing. For the purpose of stably maintaining these properties, the properties of the carrier particles contained in the two-component developers are required to be stable.

As the carrier particles which form two-component developers, there have hitherto been used various carriers such as iron powder carriers, ferrite carriers, resin-coated ferrite carriers and magnetic powder-dispersed resin carriers.

Recently office networking has been promoted, and the age of monofunctional copiers develops into the age of multifunctional copiers; the service system has also shifted from the age of the system such that a contracted service man conducts periodic maintenance inclusive of the replacement of the developer to the age of the maintenance-free system; thus, the market has further enhanced demand for further longer operating life of the developer.

Under such circumstances, for the purpose of reducing the carrier particle weight and extending the developer operating life, Japanese Patent Laid-Open No. 5-40367 and the like have proposed a variety of magnetic powder-dispersed carriers in each of which magnetic fine particles are dispersed in a resin.

Such magnetic powder-dispersed carriers can be reduced in true density by decreasing the amounts of the magnetic fine particles and can be alleviated in stress caused by stirring, and hence can be prevented from the abrasion and exfoliation of the coating film and accordingly can offer stable image properties over a long period of time.

However, the magnetic powder-dispersed carrier is high in carrier resistance because the magnetic fine particles are covered with a binder resin. Consequently, the magnetic powder-dispersed carrier offers a problem that a sufficient image density is hardly obtained.

The magnetic powder-dispersed carrier is prepared by agglomerating magnetic fine particles with a binder resin, and hence offers, as the case may be, a problem that the magnetic fine particles are detached due to the stirring stress or the impact in the developing device or a problem that the carrier particles themselves are cracked probably because the magnetic powder-dispersed carriers are inferior in mechanical strength to the iron powder carriers and ferrite carriers having hitherto been used. The detached magnetic fine particles and the cracked carrier particles adhere to the photoreceptor to cause image defects as the case may be.

Additionally, although the magnetic powder-dispersed carriers can be produced by two methods, namely, a pulverizing method and a polymerizing method, the pulverizing method is poor in yield, and the polymerizing method involves complicated production steps, and hence both methods suffer from a problem that the production cost is high.

As a substitute for the magnetic powder-dispersed carrier, there has been proposed a large number of resin-filled carriers in which the voids in a porous carrier core material are filled with a resin. For example, Japanese Patent Laid-Open No. 2006-337579 proposes a resin-filled carrier prepared by filling a resin in a ferrite core material having a porosity of 10 to 60%, Japanese Patent Laid-Open No. 2006-337579 discloses that: various methods are usable as the method for filling a resin in a core material for a resin-filled carrier; examples of such a method include a dry method, a spray drying method based on a fluidized bed, a rotary drying method and a dip-and-dry method using a universal stirrer or the like; and these methods are appropriately selected according to the core material and the resin to be used.

Further, Japanese Patent Laid-Open No. 2007-133100 describes a carrier obtained by impregnating a resin into a porous magnetic material and a carrier obtained by coating the surface of a core material with a large amount of a resin. It is stated that the true specific gravities of these carriers are light, and hence by using these carriers in a refill developer for a two-component development method in which development is conducted while a refill developer having a toner and a carrier is being fed to a developing device, with a superfluous fraction of the carrier in the developing device being discharged, where necessary, from the developing device, the superfluous fraction of the carrier can be smoothly discharged together with the toner.

The porous magnetic powers described in these Japanese Patent Laid-Open Nos. 2006-337579 and 2007-133100 intend to achieve various properties required for ferrite carriers solely by impregnating resins into porous core materials. However, such impregnation of resins into the porous core materials takes time, and additionally, when expensive resins such as a silicone resin, a fluororesin or a fluorine-modified silicone resin is used, the resulting carrier becomes inevitably expensive. Accordingly, it is difficult to claim that resin-impregnated ferrite carriers will become widely used.

Japanese Patent Laid-Open No. 2009-244572 describes a carrier core material for an electrophotographic developer wherein the carrier core material includes 3 to 100% by number of hollow particles having an iron content of 36 to 78% by weight, a carrier for an electrophotographic developer prepared by coating with a resin the surface of the carrier core material, and the production methods of these.

However, in Japanese Patent Laid-Open No. 2009-244572, as a core material obtained by thermal spraying sintering, the apparent density of the core material is small; however, the production method is limited to thermal spraying sintering, hence it is impossible to further reduce the apparent density, and consequently, a long operating life of the developer cannot be achieved.

Japanese Patent Laid-Open No. 2009-175666 discloses a resin-filled carrier for an electrophotographic developer using a porous ferrite core material having a pore volume of 0.055 to 0.16 ml/g and a peak pore size of 0.2 to 0.7 μm.

The porous ferrite core material described in Japanese Patent Laid-Open No. 2009-175666 has a high dielectric breakdown voltage and also has a high fracture strength of particles, but has a low apparent density and does not impede the impregnation of a resin.

Japanese Patent Republication No. 2005-062132 describes a resin-coated carrier for an electrophotographic developer including a spherical ferrite particle specified in volume average particle size, degree of surface uniformity, average sphericity ratio and sphericity ratio standard deviation, a production method thereof, and an electrophotographic developer.

However, as is clear from Examples and Comparative Examples of Japanese Patent Republication No. 2005-062132, even a sintering performed at a high sintering temperature with a rotary kiln does not reduce the apparent density and cannot attain a long operating life as a developer.

As shown by these conventional techniques, there has never been obtained a ferrite core material particle having a low apparent density like a resin-filled ferrite carrier, making it extremely difficult for the impregnation of a resin to occur and having small asperities on the surface of the particle. Additionally, there have never been obtained a carrier for an electrophotographic developer using such a core material particle and a developer using the carrier.

SUMMARY OF THE INVENTION

Accordingly, an object of the present invention is to provide a porous ferrite core material for an electrophotographic developer having a low apparent density, making it difficult for the impregnation of a resin to occur and having small asperities on the surface of the particle, a ferrite carrier for an electrophotographic developer using the porous ferrite core material and an electrophotographic developer using the ferrite carrier.

The present inventors made a diligent study for the purpose of solving the problems as described above, and consequently have found that the foregoing object can be achieved by using a porous ferrite core material having an apparent density, a shape factor SF-2 and a magnetization, respectively falling in specific ranges, in a resin-coated ferrite carrier obtained by coating a porous ferrite core material with a resin.

Specifically, the present invention provides a porous ferrite core material for an electrophotographic developer wherein the apparent density is 1.5 to 1.9 g/cm$^3$, the shape factor SF-2 is 101 to 110 and the magnetization as measured with a VSM measurement at $1K \cdot 1000/4\pi \cdot A/m$ is 40 to 60 Am$^2$/kg.

The porous ferrite core material for an electrophotographic developer according to the present invention preferably has a peak pore size of 0.25 to 0.6 μm and a pore volume of 0.045 to 0.09 ml/g.

The porous ferrite core material for an electrophotographic developer according to the present invention is preferably such that the full width at half maximum $W_{average}$ of the peak of the ferrite obtained by Raman spectroscopy in the vicinity of the surface of the porous ferrite core material for an electrophotographic developer is 49 to 56 cm$^{-1}$ and the standard deviation $W_d$ of the full width at half maximum is 3 cm$^{-1}$ or less.

The present invention provides a resin-coated ferrite carrier for an electrophotographic developer wherein the surface of the porous ferrite core material is coated with a resin.

In the resin-coated ferrite carrier for an electrophotographic developer according to the present invention, the surface of the porous ferrite core material is preferably coated with 0.5 to 8 parts by weight of a resin in relation to 100 parts by weight of the porous ferrite core material.

The present invention also provides electrophotographic developers each composed of any one of the above-described resin-coated ferrite carriers and of a toner.

The electrophotographic developer of the present invention is also used as a refill developer.

The porous ferrite core material for an electrophotographic developer according to the present invention has a low apparent density, makes it difficult for the impregnation of a resin to occur and has small asperities on the surface of the particle. By preparing an electrophotographic developer with the resin-coated ferrite carrier obtained by coating the surface of the porous ferrite core material with a resin together with a toner, the carrier is made to be hardly cracked, the damage to the photoreceptor is thus reduced, image defects such as white spots are diminished, the carrier particle is made light in weight to be excellent in stirring and mixing property with the toner, damage to the toner is made low and satisfactory images are obtained over a long period of time.

DETAILED DESCRIPTION OF THE EMBODIMENTS

Hereinafter, a mode for carrying out the present invention is described.

<Porous Ferrite Core Material and Resin-Coated Ferrite Carrier for an Electrophotographic Developer According to the Present Invention>

The apparent density of the porous ferrite core material for an electrophotographic developer according to the present invention is 1.5 to 1.9 g/cm$^3$ and preferably 1.55 to 1.85 g/cm$^3$. The apparent density falling within this range makes the core material light in weight and alleviates the stress in the developing device. In the case where the apparent density is less than 1.5 g/cm$^3$, when the porous ferrite core material for an electrophotographic developer is used as the ferrite carrier for an electrophotographic developer, the carrier is too light in weight and hence the charge imparting ability tends to be degraded, and the strength of the core material particle is insufficient; thus, when the porous ferrite core material is used as the carrier, the carrier is cracked and the chipping of the carrier occurs to impart damage to the photoreceptor to offer a cause for image defects such as white spots. When the apparent density exceeds 1.9 g/cm$^3$, the weight reduction of the carrier is not sufficient and the durability of the carrier becomes poor in use as a developer. The apparent density is measured as follows.

[Apparent Density]

The apparent density was measured in conformity with JIS-Z-2504. The details are as follows.

1. Apparatus

A powder apparent density meter composed of a funnel, a cup, a funnel supporter, a supporting rod and a supporting base is used. A balance having a weighing capacity of 200 g and a weighing sensitivity of 50 mg is used.

2. Measurement Method (1) A sample weighs at least 150 g or more.

(2) The sample is poured into the funnel having an orifice with an orifice aperture size of $2.5^{+0.2/-0}$ mm until the sample flowing from the funnel into a cup fills the cup and starts to brim over the cup.

(3) When the sample starts to brim over the cup, immediately the pouring of the sample is stopped, and the heaped portion of the sample is removed with a spatula, without shaking the sample, along the top edge of the cup so as for the top surface of the sample to be flat.

(4) The side of the cup is lightly tapped to lower the sample, the sample attaching to the outside of the cup is removed, and the sample inside the cup is weighed to a precision of 0.05 g.

3. Calculation

The measured value, obtained in the previous item 2-(4) is multiplied with 0.04, and the value thus obtained is rounded to the second decimal place according to JIS-Z-8401 (method for rounding numerical values) to be defined as an apparent density given in units of g/cm$^3$.

The shape factor SF-2 of the porous ferrite core material for an electrophotographic developer according to the present invention is 101 to 110 and preferably 102 to 109. The shape factor SF-2 of 101 to 110 means the formation of appropriate asperities on the surface of the core material, and such asperities facilitate the achievement of the anchoring effect of the resin in the coating of the surface with a resin. When the average value of the SF-2 is less than 101, the asperities on the surface are reduced to an extreme extent. Accordingly, when the ferrite core material is coated with a resin and is used as the carrier, the coated resin tends to be detached, with a high probability of the occurrence of the significant change of the properties of the developer with time. When the average value of the SF-2 is larger than 110, the asperities on the surface are too large. Accordingly, when the ferrite core material is coated with a resin, the resin tends to penetrate into the core material to an excessive extent, and hence an intended coating amount of the resin sometimes does not result in targeted charging properties and resistance properties with a satisfactory balance therebetween.

(Shape Factor SF-2 (Circularity))

The shape factor SF-2 is a numerical value obtained by dividing by 4π the square of the projected peripheral length of the carrier and by multiplying the resulting quotient by 100; the closer to a sphere the shape of the carrier is, the closer to 100 the value of the shape factor SF-2 is. The shape factor SF-2 (circularity) is measured as follows.

By using a grain size/shape distribution analyzer PITA-1 manufactured by Seishin Enterprise Co., Ltd., 3000 core material particles were observed, S (projected area) and L (projected peripheral length) were derived with the software, ImageAnalysis, appended to the apparatus, and the shape factor SF-2 was derived with the following formula. The closer to a sphere the shape of the carrier is, the closer to 100 the value of the shape factor SF-2 is.

A sample solution prepared as follows was used: an aqueous solution of xanthane gum, having a viscosity of 0.5 Pa·s was prepared as a dispersion medium, and 0.1 g of core material particles were dispersed in 30 cc of the aqueous solution of xanthane gum to be used as the sample solution. Such a proper adjustment of the dispersion medium viscosity allows the core material particles to maintain the condition of being kept dispersed and thus allows the measurement to be performed smoothly. The measurement conditions are as follows: the magnification of the (objective) lens was 10×; the filters were ND4×2; for each of the carrier solution 1 and the carrier solution 2, the aqueous solution of xanthane gum, having a viscosity of 0.5 Pa·s was used; the flow rate of either of the carrier solutions 1 and 2 was 10 μl/sec, and the flow rate of the sample solution was 0.08 μl/sec.

$$SF\text{-}2=(L^2/S/4\pi)\times 100$$

where L represents the projected peripheral length and S represents the projected area.

The porous ferrite core material for an electrophotographic developer according to the present invention has a magnetization of 40 to 60 Am$^2$/kg as measured with a VSM measurement at an applied magnetic field of 1K·1000/4π·A/m. When the magnetization is less than 40 Am$^2$/g, the scattered matter magnetization is deteriorated and offers a cause for image defects due to carrier beads carry over. On the other hand, the magnetization does not exceed 60 Am$^2$/g. The magnetic property (magnetization) is measured as follows.

(Magnetic Property)

A vibrating sample magnetometer (model: VSM-C7-10A, manufactured by Toei Industry Co., Ltd.) was used. A measurement sample was packed into a cell of 5 mm in inner diameter and 2 mm in height to be set in the above-described apparatus. In the measurement, a magnetic field was applied and the magnetic field was scanned up to a maximum of 1K·1000/4π·A/m. Then, the applied magnetic field was decreased, and thus a hysteresis loop was depicted on a sheet of recording paper. From the data provided by this loop, the magnetization at an applied magnetic field of 1K·1000/4π·A/m was read out.

In the porous ferrite core material for an electrophotographic developer according to the present invention, the pore volume is preferably 0.045 to 0.09 ml/g, and the peak pore size is preferably 0.25 to 0.6 μm. The pore volume of the porous ferrite is more preferably 0.045 to 0.085 ml/g. The peak pore size of the porous ferrite is more preferably 0.25 to 0.55 μm.

When the pore volume of the porous ferrite core material is less than 0.045 ml/g, the apparent density is too large, and hence the weight reduction cannot be achieved, and additionally, when the porous ferrite core material is used as a carrier, the stirring stress tends to be exerted to cause the cracking or the chipping of the carrier particles, thus the photoreceptor is damaged, and thus such a pore volume offers a cause for image defects such as white spots. When the pore volume of the porous ferrite core material exceeds 0.09 ml/g, the apparent density is too small, the strength as the carrier particle cannot be maintained; also in this case, the cracking or the chipping of the carrier particle occurs, thus the photoreceptor is damaged, and thus such a pore volume offers a cause for image defects such as white spots.

When the peak pore size of the porous ferrite core material is less than 0.25 μm, no anchoring effect of the resin is obtained in coating with a resin, and additionally, the resin coating performed with an intended resin coating amount results in the excessive presence of the resin on the surface of the core material, thus the carrier particles are mutually aggregated, and the excessive resin remains as resin powder on the surface of the carrier, so as to inhibit the achievement of the intended charging property and the intended resistance. On the other hand, when the peak pore size of the porous ferrite core material exceeds 0.6 μm, the carrier after coating undergoes the occurrence of immoderate asperities to make poor the particle strength and to offer causes for charge leakage and toner spent. Moreover, the intended resin coating amount results in complete impregnation of the resin into the core material to inhibit the achievement of the intended properties of the carrier.

As described above, the pore volume and the peak pore size designed to fall within the above-described ranges enable to obtain a resin-coated ferrite carrier that is free from the above-described problems and is appropriately reduced in weight.

[Pore Size and Pore Volume of the Porous Ferrite Core Material]

The measurement of the pore size and pore volume of the porous ferrite core material is conducted as follows. Specifically, the measurement is conducted with the mercury porosimeters, Pascal 140 and Pascal 240 (manufactured by Thermo Fisher Scientific K.K.). A dilatometer CD3P (for powder) is used, and a sample is put in a commercially available gelatin capsule with a plurality of bored holes and the capsule is placed in the dilatometer. After deaeration with Pascal 140, mercury is charged and a measurement in the lower pressure region (0 to 400 kPa) is conducted as a first run. Successively, the deaeration and another measurement in the lower pressure region (0 to 400 kPa) are conducted as a second run. After the second run, the total weight of the dilatometer, the mercury, the capsule and the sample is measured. Next, a high pressure region (0.1 MPa to 200 MPa) measurement is conducted with Pascal 240. From the amount of the intruded mercury as measured in the high pressure region measurement, the pore volume, pore size distribution and the peak pore size of the porous ferrite core material are derived. The pore size is derived with the surface tension and the contact angle of mercury of 480 dyn/cm and 141.3°, respectively.

In the porous ferrite core material for an electrophotographic developer according to the present invention, the full width at half maximum W average of the peak of the ferrite obtained by Raman spectroscopy in the vicinity of the surface of the porous ferrite core material for an electrophotographic developer is 49 to 56 $cm^{-1}$ and the standard deviation $W_d$ of the full width at half maximum is 3 $cm^{-1}$ or less. These ranges allow the crystallinity difference between the surface and the interior of the ferrite core material to be small, and the strength of the ferrite core material is maintained. When the $W_{average}$ is less than 49 $cm^{-1}$, an excessive progress of the sintering is meant, the core material particles in a porous condition are not obtained, and it is also meant that the carrier tends to be easily cracked due to the stress in the interior of the core material particles. On the other hand, when the $W_{average}$ is larger than 56 $cm^{-1}$, it is meant that the heat amount at the time of sintering is insufficient, no sufficient crystallinity is obtained, and the carrier tends to be cracked. When the value of the standard deviation $W_d$ of the full width at half maximum is larger than 3 $cm^{-1}$, it is meant that the way of the heat application from the surface to the interior of the core material particle varies from particle to particle and the crystallinity difference becomes large. In other words, it is meant that there are portions tending to undergo application of stress in the interior of the particles and the particles tend to be cracked. The full width at half maximum is measured as follows.

(Full Width at Half Maximum)

The full width at half maximum was measured with a Raman microscope XploRA (Horiba, Ltd.). A sample prepared as follows was used: the core material particles were embedded and immobilized in epoxy resin, the resulting particle-embedded resin was polished with an abrasive, and thus the cross sections of the core material particles were exposed to complete the sample preparation. The measurement was performed under the following measurement conditions: data acquisition time: 60 sec, excitation wavelength: 532.023 nm, number of integration cycles: 2, output power of excitation laser: 0.1 mW, filter: 1% neutral density filter, confocal hole: 300 μm, magnification of an objective lens: 100×, slit width: 100 μm, and groove density of grating: 1800/mm. Spectroscopic analysis was performed from the center of the particle cross section to the uppermost surface with a laser spot diameter of 1 μm at intervals of 2 μm; thus, at each of the measurement points, the data for the relation between the Raman shift and the scattered light intensity were obtained. The peak due to the ferrite somewhat varies depending on the composition and the production conditions of the ferrite; however, the peak having the strongest intensity and appearing at around 600 to 620 $cm^{-1}$ in terms of the Raman shift is the concerned peak; the full width at half maximum corresponding to the normalized height of the peak was used as an index of the crystallinity of the ferrite. The full width at half maximum indicates that the narrower the full width at half maximum of the peak, the better the crystallinity; the broader the full width at half maximum of the peak, the worse the crystallinity. As the core material particles to be the objects of the measurement, 50 core material particles were selected beforehand in such a way that the Feret diameters of the cross sections of the core material particles fell within a range of the volume average particle size×(1±0.1) as measured with a laser diffraction particle size distribution analyzer.

The carrier core material for an electrophotographic developer according to the present invention is preferably such that the volume average particle size as measured with a laser diffraction particle size distribution analyzer is preferably 15 to 120 μm, more preferably 15 to 80 μm and most preferably 15 to 60 μm. When the volume average particle size is less than 15 μm, unpreferably carrier beads carry over tends to occur. When the volume average particle size exceeds 120 μm, unpreferably image quality degradation tends to be caused. The volume average particle size was measured as follows.

(Volume Average Particle Size)

As the apparatus, the Microtrac Particle Size Analyzer (model 9320-X100) manufactured by Nikkiso Co., Ltd. was used. Water was used as a dispersion medium.

The BET specific surface area of the porous ferrite core material for an electrophotographic developer according to the present invention is preferably 0.4 to 1 $m^2/g$ and more preferably 0.4 to 0.95 $m^2/g$.

In the case where the BET specific surface area is smaller than the aforementioned range, even when the resin coating is performed, sometimes no sufficient anchoring effect of the resin is achieved, and additionally, the carrier core material particles are sometimes mutually aggregated due to the resin not used for coating. Accordingly, the substantial coating resin amount is reduced, and hence the operating life as the carrier is shortened, and the disintegration of the aggregated carrier particles in the developing device results in significant exposure of the surface of the core material and results in resistance reduction, so as to offer a cause for the occurrence of carrier scattering. In the case where the BET specific surface area is larger than the aforementioned range, the coating resin does not stay on the surface of the core material, but is impregnated into the core material to an excessive extent, and thus, sometimes no intended resistance and no intended charge amount are obtained. When the measurement of the BET specific surface area is conducted, because the measurement results are strongly affected by the moisture on the surface of the measurement sample, namely, the core material particles, it is preferable to perform a pretreatment to remove the moisture attached to the surface of the sample as completely as possible.

(BET Specific Surface Area)

In the BET specific surface area measurement, a specific surface area analyzer (model: Macsorb HM model-1208 (manufactured by Mountech Ltd.)) was used. In a standard sample cell dedicated to the specific surface area analyzer, about 5 to 7 g of a measurement sample was placed; the sample was weighed accurately with a precision balance, the sample was set on the measurement port and the measurement was started. The measurement was performed by the one-point method, and the BET specific surface area was automatically calculated by inputting the weight of the sample at the time of the completion of the measurement. Before the measurement, as a pretreatment, approximately 20 g of the measurement sample was placed on a medical paper, and then placed in a vacuum dryer; the vacuum dryer was deaerated to a degree of vacuum of −0.1 MPa, then the degree of vacuum was verified to be −0.1 MPa or less, and the sample was heated at 200° C. for 2 hours.

Environment: temperature: 10 to 30° C., humidity: 20 to 80% in terms of relative humidity, no dew condensation In the porous ferrite core material for an electrophotographic developer according to the present invention, the composition thereof includes: Mn in a content of preferably 10 to 25% by weight and more preferably 12 to 25% by weight; Mg in a content of preferably 0.2 to 3% by weight and more preferably 0.3 to 2.5% by weight; and Fe in a content of preferably 48 to 60% by weight and more preferably 49 to 60% by weight. Within the aforementioned composition range, the magnetization is easily obtained, and the intended surface property, the intended asperities and the intended apparent density are easily obtained.

The porous ferrite core material used in the present invention preferably includes Sr in a content of 1% by weight or less. When the Sr content exceeds 1% by weight, the porous ferrite core material starts changeover to hard ferrite, and hence there is a possibility that the fluidity of the developer is rapidly degraded on a magnetic brush.

Mn improves the balance between the resistance and the magnetization according to applications. In this case, in particular, there can be expected an effect of preventing the reoxidation at the time of taking out from the furnace in sintering. In the case where no intentional addition of Mn is possible, the inclusion of a trace amount of Mn as an impurity originating from the raw material causes no problem. The form of Mn at the time of addition is not particularly limited; however, $MnO_2$, $Mn_2O_3$, $Mn_3O_4$ and $MnCO_3$ are preferable because of easy availability for industrial use.

With respect to Mg, MgO is inclined to the plus side in the electronegativity scale and hence Mg is compatible with minus toners to an extreme extent, and thus a developer, satisfactory in charging rise, constituted with a magnesium ferrite carrier containing MgO and a full-color toner can be obtained.

The Fe content of less than 48% by weight means that the addition amount of Mg and/or Mn is relatively increased to increase the nonmagnetic component and/or the low magnetization component depending on the sintering conditions, and hence no intended magnetic properties are obtained; the Fe content exceeding 60% by weight does not attain the effects of the addition of Mg and/or Mn and results in a porous ferrite core material (carrier core material) substantially equivalent to $Fe_3O_4$. The Mg and Mn contents (molar ratio) are most satisfactorily such that the molar ratio Mg:Mn falls approximately within a range from 1:2 to 1:30. The Mg content of less than 0.2% by weight decreases the production amount of the magnesium ferrite phase in the carrier core material and the subtle oxygen concentration at the time of sintering tends to result in significant variation of the magnetization and the resistance; the Mg content exceeding 3% by weight increases the production amount of magnesium ferrite in the carrier core material, and hence results in a possibility that no intended magnetic properties are obtained. The Mn content of less than 10% by weight decreases the production amount of the manganese ferrite phase in the carrier core material and the subtle oxygen concentration at the time of sintering tends to result in significant variation of the magnetization and the resistance; the Mn content exceeding 25% by weight increases the production amount of manganese ferrite in the carrier core material, and hence results in a possibility that the magnetization tends to be too high and the image defects such as brush lines are caused.

(Contents of Fe, Mg, Mn and Sr)

These contents of Fe, Mg, Mn and Sr are measured as follows.

A porous ferrite core material (carrier core material) was weighed out in an amount of 0.2 g, a solution prepared by adding 20 ml of 1N hydrochloric acid and 20 ml of 1N nitric acid to 60 ml of pure water was heated, the carrier core material was completely dissolved in the solution to prepare an aqueous solution, and the contents of Fe, Mg, Mn and Sr were measured with an ICP analyzer (ICPS-10001V, manufactured by Shimadzu Corp.).

The porous ferrite core material for an electrophotographic developer according to the present invention may be subjected to a surface oxidation treatment. The surface oxidation treatment forms a surface film, and the thickness of the surface film is preferably 0.1 nm to 5 μm. When the thickness of the surface film is less than 0.1 nm, the effect of the oxide coating film is small, and when the thickness of the surface film exceeds 5 μm, obviously the magnetization is degraded or the electric resistance becomes too high, and thus a problem such that the developing power is degraded tends to be caused. Additionally, where necessary, reduction may be conducted before the oxidation treatment. The thickness of the oxide coating film can be measured from a SEM photograph, and with an optical microscope and a laser microscope, each having such a high magnification that permits identification of the formation of the oxide coating film. It is to be noted that the oxide coating film may be formed uniformly or partially on the surface of the core material.

The resin-coated ferrite carrier for an electrophotographic developer according to the present invention has a structure in which the surface of the aforementioned porous ferrite core material is coated with a resin. The number of times of resin coating may be only one, or two or more times of resin coating may also be performed; the number of times of coating can be determined according to the intended properties. The composition and the coating amount of the coating resin, and the apparatus used for resin coating may be varied or may be kept unchanged when the number of times of coating is two or more.

The resin-coated ferrite carrier for an electrophotographic developer according to the present invention is such that the resin coating amount is preferably 0.5 to 8 parts by weight, more preferably 0.5 to 6 parts by weight and particularly preferably 0.5 to 5 parts by weight in relation to 100 parts by weight of the porous ferrite core material. When the resin coating amount is less than 0.5 parts by weight, it is difficult to form a uniform coating film layer on the surface of the porous ferrite core material. When the resin coating amount exceeds 8 parts by weight, the mutual aggregation of the ferrite carrier particles occurs to offer the causes for the productivity degradation including the process yield decrease, and the causes for the variation of the properties of the developer in the actual machine such as the fluidity and the charge amount.

The coating resin used herein can be appropriately selected according to the toner to be combined therewith, the use environment and the like. The type of the coating resin is not particularly limited; however, examples of the coating resin include: fluororesins, acrylic resins, epoxy resins, polyamide resins, polyamideimide resins, polyester resins, unsaturated polyester resins, urea resins, melamine resins, alkyd resins, phenolic resins, fluoroacrylic resins, acryl-styrene resins and silicone resins; and modified silicone resins obtained by modification with a resin such as an acrylic resin, a polyester resin, an epoxy resin, a polyamide resin, a polyamideimide resin, an alkyd resin, a urethane resin, or a fluororesin. In the present invention, acrylic resin, silicone resin or modified silicone resin is most preferably used.

For the purpose of controlling the electric resistance and the charge amount and the charging rate of the carrier, a conductive agent can be added in the coating resin. The electric resistance of the conductive agent itself is low, and hence when the content of the conductive agent is too large, a rapid charge leakage tends to occur. Accordingly, the content of the conductive agent is 0.25 to 20.0% by weight, preferably 0.5 to 15.0% by weight and particularly preferably 1.0 to 10.0% by weight in relation to the solid content of the coating resin. Examples of the conductive agent include conductive carbon, oxides such as titanium oxide and tin oxide, and various organic conductive agents.

Additionally, a charge controlling agent can be contained in the coating resin. Examples of the charge controlling agent include various types of charge controlling agents generally used for toners and various silane coupling agents. This is because in a case where the exposed area of the core material is controlled by the resin coating so as to be relatively small, the charge imparting ability is sometimes degraded, but the addition of various types of charge controlling agents and silane coupling agents enables the control of the degradation of the charge imparting ability. The types of the usable charge controlling agents and usable silane coupling agents are not particularly limited; however, preferable examples of the usable charge controlling agents and silane coupling agents include: charge controlling agents such as nigrosine dyes, quaternary ammonium salts, organometallic complexes and metal-containing monoazo dyes; and aminosilane coupling agents and fluorine silane coupling agents.

In the porous ferrite carrier for an electrophotographic developer according to the present invention, the apparent density is 1.5 to 1.9 g/cm$^3$, the carrier strength is preferably 3.5% by volume or less, and the magnetization as measured with a VSM measurement at an applied magnetic field of $1K \cdot 1000/4\pi \cdot A/m$ is 40 to 60 Am$^2$/kg.

The apparent density falling within this range allows the core material to be reduced in weight, and allows the stress in the developing device to be alleviated. When the apparent density is less than 1.5 g/cm$^3$, the carrier is too light in weight and hence the charge imparting ability tends to be degraded, and additionally, the strength of the core material particle is insufficient; accordingly, when the porous ferrite core material is used as a carrier, the cracking or the chipping of the carrier occurs, thus the photoreceptor is damaged, and thus such a carrier offers a cause for image defects such as white spots. When the apparent density exceeds 1.9 g/cm$^3$, the weight reduction of the carrier is insufficient, and the carrier is poor in durability when used as a component of a developer. The measurement method of the apparent density is as described above.

The case where the strength exceeds 3.5% by volume means that the core material particle tends to be cracked; when such core material particle is used as the carrier, the cracking or the chipping of the carrier occurs, thus the photoreceptor is damaged, and thus such a carrier offers a cause for image defects such as white spots. The measurement method of the strength is described below.

When the magnetization falls within the aforementioned range, the carrier scattering is not caused, and additionally, the image defects such as brush lines do not occur, and hence satisfactory printed matter is obtained. On the other hand, when the magnetization is less than 40 Am$^2$/g, the scattered matter magnetization is deteriorated, and such a magnetization offers a cause for image defects due to carrier beads carry over. On the other hand, the magnetization does not exceeds 60 Am$^2$/g. The measurement method of this magnetic property (magnetization) is as described above.

<Production Method of the Porous Ferrite Core Material and the Resin-Coated Ferrite Carrier for an Electrophotographic Developer According to the Present Invention>

Next, a production method of the porous ferrite core material and the resin-coated ferrite carrier for an electrophotographic developer according to the present invention is described.

For the purpose of producing the porous ferrite core material for an electrophotographic developer according to the present invention, the raw materials are weighed in appropriate amounts, and then mixed with a mixer such as a Henschel mixer for 0.1 hour or more and more preferably for 0.1 to 5 hours. The raw materials are not particularly limited, but are preferably selected so as to give the composition containing the above-described elements.

The mixture thus obtained is converted into a pellet with a compression molding machine or the like, and then the pellet is calcined at a temperature of 700 to 1200° C. The calcination atmosphere may be the air or the calcination may be conducted in a nonoxidative atmosphere. Without using a compression molding machine, after pulverization, the pulverized mixture may be converted into a slurry by adding water thereto, and the slurry may be converted into particles by using a spray dryer. After the calcination, further pulverization is conducted with a ball mill, a vibration mill or the like, thereafter water and, where necessary, a dispersant, a binder and the like are added, the viscosity is adjusted, and then particles are prepared with a spray dryer for granulation. In this case, the slurry particle size is preferably 1.5 to 4.5 pa. In the pulverization after the calcination, pulverization may also be conducted by adding water with a wet ball mill, a wet vibration mill or the like.

The above-described pulverizing machine such as the ball mill or the vibration mill is not particularly limited; however, for the purpose of effectively and uniformly pulverizing the raw materials, it is preferable to adopt fine beads having a particle size of 5 mm or less as the media to be used. By regulating the size and the composition of the beads used and the pulverization time, the degree of pulverization can be controlled.

Then, the granulated substance thus obtained is sintered in an oxygen concentration-controlled atmosphere, at a temperature of 900 to 1050° C., by using a rotary kiln wherein the sintering time is controlled to be 5 to 300 minutes. In this case, the atmosphere at the time of sintering may be different from the air in such a way that the oxygen concentration control of the atmosphere is controlled by introducing an inert gas such as nitrogen. Alternatively, the sintering may be performed a large number of times by changing the atmosphere and the sintering temperatures. In particular, it is most preferable to use the reducing gas generated by incompletely combusting in nitrogen the binder contained in the granulated substance because it is not necessary to prepare another reducing gas. On the other hand, the sintering using hydrogen gas should not be used because such a sintering has a too strong reducing ability, and hence it is difficult to obtain an intended peak pore size or an intended pore volume, and additionally, trivalent iron contained in the granulated substance in an amount more than necessary is reduced to generate wustite, and hence the magnetization tends to be decreased.

The sintered substance thus obtained is pulverized and classified. As the classification method, the existing methods such as a pneumatic classification method, a mesh filtration method and a precipitation method are used to regulate the particle size to an intended particle size.

Thereafter, where necessary, by applying low temperature heating to the surface, an oxide coat treatment is conducted and thus electric resistance can be regulated. In the oxide coat treatment, a common rotary electric furnace, a common batch electric furnace or the like is used to allow the heat treatment to be conducted, for example, at 180 to 500° C. The thickness of the oxide coat formed by this treatment is preferably 0.1 nm to 5 μm. When the thickness is less than 0.1 nm, the effect of the oxide coat layer is small, and when the thickness exceeds 5 μm, the magnetization is degraded or the resistance becomes too high, and thus unpreferably intended properties are hardly obtained. Where necessary, reduction may be conducted before the oxide coat treatment. In this way, the porous ferrite core material in which the apparent density, the shape factor SF-2 and the magnetization respectively fall within the specific ranges can be prepared.

As such methods as described above for the controlling of the apparent density, the shape factor SF-2 and the magnetization of the ferrite core material for an electrophotographic developer, the above-described controlling can be performed by various methods involving the types of the raw materials to be mixed, the pulverization degree of the raw materials, the application or nonapplication of calcination, the calcination temperature, the calcination time, the amount of the binder at the time of granulation with a spray dryer, the sintering method, the sintering temperature, the sintering time, the sintering atmosphere or the like. These controlling methods are not particularly limited, and an example of such methods is described below.

Specifically, the use of hydroxides or carbonates as the raw materials to be mixed tends to increase the pore volume as compared to the use of oxides; additionally, nonapplication of calcination or a lower calcination temperature, or a lower sintering temperature combined with a shorter sintering time tends to increase the pore volume.

The peak pore size tends to be small by enhancing the degree of pulverization of the raw materials used, in particular, the raw materials having been calcined so as to make fine the primary particle size in the pulverization. In the sintering, rather than the use of an inert gas such as nitrogen, the introduction of a reducing gas such as hydrogen or carbon monoxide enables to reduce the peak pore size.

The control of the magnetic properties such as saturation magnetization can be performed by the surface oxidation treatment of the porous core material particles as well as by varying the composition proportions of Mg, Mn, Sr and Fe. Additionally, the degree of reduction in the sintering can also be controlled by varying the addition amount of the binder at the time of the granulation.

By using these controlling methods each alone or in combinations thereof, a porous ferrite core material having the intended pore volume, peak pore size and saturation magnetization can be obtained.

Then, where necessary, by applying low temperature heating to the surface, an oxide film forming treatment is performed and thus electric resistance can be regulated. In the oxide film forming treatment, a common rotary electric furnace, a common batch electric furnace or the like is used to allow the heat treatment to be performed, for example, at 600° C. or lower. It is preferable to use a rotary electric furnace for the purpose of uniformly forming the oxide film on the core material particles.

By coating with a resin the thus obtained porous ferrite core material for an electrophotographic developer according to the present invention, a resin coating layer is formed and thus a resin-coated ferrite carrier for an electrophotographic developer is prepared.

As the method for the resin coating, heretofore known methods such as a brush coating method, a spray drying method based on a fluidized bed, a rotary drying method and a dipping-and-drying method using a universal stirrer can be applied for coating. For the purpose of improving the coverage factor, the method based on a fluidized bed is preferable.

When baking is conducted after coating the porous ferrite core material with a resin, either an external heating method or an internal heating method may be used; for example, a fixed electric furnace, a flowing electric furnace, a rotary electric furnace or a burner furnace may be used, or baking with microwave may also be adopted. When a UV curable resin is used, a UV heater is used. The baking temperature is varied depending on the resin used; the baking temperature is required to be a temperature equal to or higher than the melting point or the glass transition point; when a thermosetting resin, a condensation-crosslinking resin or the like is used, the baking temperature is required to be increased to a temperature allowing the curing to proceed sufficiently.

<Electrophotographic Developer According to the Present Invention>

Next, the electrophotographic developer according to the present invention is described.

The electrophotographic developer according to the present invention is composed of the above-described resin-coated ferrite carrier for an electrophotographic developer and a toner.

Examples of the toner particle that constitutes the electrophotographic developer of the present invention include a pulverized toner particle produced by a pulverization method and a polymerized toner particle produced by a polymerization method. In the present invention, the toner particle obtained by either of these methods can be used.

The pulverized toner particle can be obtained, for example, by means of a method in which a binder resin, a charge controlling agent and a colorant are fully mixed together with a mixing machine such as a Henschel mixer, then the mixture thus obtained is melt-kneaded with an apparatus such as a double screw extruder, and the melt-kneaded substance is cooled, pulverized and classified, added with an external additive, and thereafter mixed with a mixing machine such as a mixer to yield the pulverized toner particle.

The binder resin that constitutes the pulverized toner particle is not particularly limited. However, examples of the binder resin may include polystyrene, chloropolystyrene, styrene-chlorostyrene copolymer, styrene-acrylate copolymer and styrene-methacrylic acid copolymer, and further, rosin-modified maleic acid resin, epoxy resin, polyester resin and polyurethane resin. These binder resins are used each alone or as mixtures thereof.

As the charge controlling agent, any charge controlling agent can be used. Examples of the charge controlling agent for use in positively charged toners may include nigrosine dyes and quaternary ammonium salts. Additionally, examples of the charge controlling agent for use in negatively charged toners may include metal-containing monoazo dyes.

As the colorant (coloring material), hitherto known dyes and pigments can be used. Examples of the usable colorant include carbon black, phthalocyanine blue, permanent red, chrome yellow and phthalocyanine green. Additionally, for the purpose of improving the fluidity and the anti-aggregation property of the toner, external additives such as a silica powder and titania can be added to the toner particle according to the toner particle.

The polymerized toner particle is a toner particle produced by heretofore known methods such as a suspension polymerization method, an emulsion polymerization method, an emulsion aggregation method, an ester extension polymerization method and a phase inversion emulsion method. Such a polymerized toner particle can be obtained, for example, as follows: a colorant dispersion liquid in which a colorant is dispersed in water with a surfactant, a polymerizable monomer, a surfactant and a polymerization initiator are mixed together in a aqueous medium under stirring to disperse the polymerizable monomer by emulsification in the aqueous medium; the polymerizable monomer thus dispersed is polymerized under stirring for mixing; thereafter, the polymer particles are salted out by adding a salting-out agent; the particles obtained by salting-out is filtered off, rinsed and dried, and thus the polymerized toner particle can be obtained. Thereafter, where necessary, an external additive can be added to the dried toner particle for the purpose of providing a function.

Further, when the polymerized toner particle is produced, in addition to the polymerizable monomer, the surfactant, the polymerization initiator and the colorant, a fixability improving agent and a charge controlling agent can also be mixed; the various properties of the obtained polymerized toner particle can be controlled and improved by these agents. Additionally, a chain transfer agent can also be used for the purpose of improving the dispersibility of the polymerizable monomer in the aqueous medium and regulating the molecular weight of the obtained polymer.

The polymerizable monomer used in the production of the polymerized toner particle is not particularly limited. However, example of such a polymerizable monomer may include: styrene and the derivatives thereof; ethylenically unsaturated monoolefins such as ethylene and propylene; vinyl halides such as vinyl chloride; vinyl esters such as vinyl acetate; and α-methylene aliphatic monocarboxylic acid esters such as methyl acrylate, ethyl acrylate, methyl methacrylate, ethyl methacrylate, 2-ethylhexyl methacrylate, acrylic acid dimethylamino ester and methacrylic acid diethylamino ester.

As the colorant (coloring material) used when the polymerized toner particle is prepared, hitherto known dyes and pigments can be used. Examples of the usable colorant include carbon black, phthalocyanine blue, permanent red, chrome yellow and phthalocyanine green. Additionally, the surface of each of these colorants may be modified by using a silane coupling agent, a titanium coupling agent or the like.

As the surfactant used in the production of the polymerized toner particle, anionic surfactants, cationic surfactants, amphoteric surfactants and nonionic surfactants can be used.

Here, examples of the anionic surfactants may include: fatty acid salts such as sodium oleate and castor oil; alkyl sulfates such as sodium lauryl sulfate and ammonium lauryl sulfate; alkylbenzenesulfonates such as sodium dodecylbenzenesulfonate; alkylnaphthalenesulfonates; alkylphosphoric acid ester salts; naphthalenesulfonic acid-formalin condensate; and polyoxyethylene alkyl sulfuric acid ester salts. Additionally, examples of the nonionic surfactants may include: polyoxyethylene alkyl ethers, polyoxyethylene fatty acid esters, sorbitan fatty acid esters, polyoxyethylene alkylamines, glycerin, fatty acid esters and oxyethylene-oxypropylene block polymer. Further, examples of the cationic surfactants may include: alkylamine salts such as laurylamine acetate; and quaternary ammonium salts such as lauryltrimethylammonium chloride and stearyltrimethylammonium chloride. Additionally, examples of the amphoteric surfactants may include aminocarboxylic acid salts and alkylamino acids.

The above-described surfactants can each be used usually in a range from 0.01 to 10% by weight in relation to the polymerizable monomer. Such a surfactant affects the dispersion stability of the monomer, and also affects the environment dependence of the obtained polymerized toner particle. The use of a surfactant within the aforementioned range is preferable from the viewpoint of ensuring the dispersion stability of the monomer and alleviating the environment dependence of the polymerized toner particle.

For the production of the polymerized toner particle, usually a polymerization initiator is used. Examples of the polymerization initiator include water-soluble polymerization initiators and oil-soluble polymerization initiators. In the present invention, either of a water-soluble polymerization initiator and an oil-soluble polymerization initiator can be used. Examples of the water-soluble polymerization initiator usable in the present invention may include: persulfates such as potassium persulfate and ammonium persulfate; and water-soluble peroxide compounds. Additionally, examples of the oil-soluble polymerization initiator usable in the present invention may include: azo compounds such as azobisisobutyronitrile; and oil-soluble peroxide compounds.

Additionally, for a case where a chain transfer agent is used in the present invention, examples of the chain transfer agent may include: mercaptans such as octylmercaptan, dodecylmercaptan and tert-dodecylmercaptan; and carbon tetrabromide.

Further, for a case where the polymerized toner particle used in the present invention contains a fixability improving agent, examples of the usable fixability improving agent include: natural waxes such as carnauba wax; and olefin waxes such as polypropylene wax and polyethylene wax.

Additionally, for a case where the polymerized toner particle used in the present invention contains a charge controlling agent, the charge controlling agent used is not particularly limited, and examples of the usable charge controlling agent include nigrosine dyes, quaternary ammonium salts, organometallic complexes and metal-containing monoazo dyes.

Additionally, examples of the external additives used for improving the fluidity and the like of the polymerized toner particle may include silica, titanium oxide, barium titanate, fluororesin fine particles and acrylic resin fine particles. These external additives can be used each alone or in combinations thereof.

Further, examples of the salting-out agent used for separation of the polymerized particles from the aqueous medium may include metal salts such as magnesium sulfate, aluminum sulfate, barium chloride, magnesium chloride, calcium chloride and sodium chloride.

The volume average particle size of the toner particle produced as described above falls in a range from 2 to 15 μm and preferably in a range from 3 to 10 μm, and the polymerized toner particle is higher in the particle uniformity than the pulverized toner particle. When the average particle size of the toner particle is smaller than 2 μm, the charging ability is degraded to tend to cause fogging or toner scattering; when larger than 15 μm, such a particle size offers a cause for image quality degradation.

Mixing of the carrier and the toner produced as described above can yield an electrophotographic developer. The mixing ratio between the carrier and the toner, namely, the toner concentration is preferably set at 3 to 15% by weight. When the toner concentration is less than 3% by weight, it is difficult to attain a desired image density; when larger than 15% by weight, toner scattering or fogging tends to occur.

The electrophotographic developer according to the present invention can also be used as a refill developer. In this case, the mixing ratio between the toner and the carrier, namely, the toner concentration is preferably set at 100 to 3000% by weight.

The electrophotographic developer according to the present invention, prepared as described above, can be used in a digital image formation apparatus, such as a copying machine, a printer, a FAX machine or a printing machine, adopting a development method in which an electrostatic latent image formed on a latent image holder having an organic photoconductor layer is reversely developed, while applying a bias electric field, with a magnetic brush of a two-component developer having a toner and a carrier. Additionally, the electrophotographic developer according to the present invention is also applicable to an image formation apparatus, such as a full-color machine, which adopts a method applying an alternating electric field composed of a DC bias and an AC bias superposed on the DC bias when a development bias is applied from the magnetic brush to the electrostatic latent image.

Hereinafter, the present invention is specifically described on the basis of Examples and others.

Example 1

Raw materials were weighed out in such a way that the amounts of $Fe_2O_3$, $Mn_3O_4$, $Mg(OH)_2$ and $SrCO_3$ were 55, 12, 9 and 0.8 mol, respectively, and were dry mixed with a Henschel mixer for 10 minutes to yield a raw material mixture. The obtained raw material mixture was converted into a pellet by using a roller compactor. The pelletized raw material mixture was calcined by using a rotary kiln. The calcination was performed at a calcination temperature of 1080° C. in the air.

Next, the obtained calcined substance was coarsely pulverized by using a rod mill, and then pulverized for 2 hours with a wet ball mill by using stainless steel beads of 3/16 inches in diameter to yield a slurry. The particle size (primary particle size of the pulverized substance) of the slurry thus obtained was measured with a laser diffraction particle size distribution analyzer, and consequently the $D_{50}$ value was found to be 2.14 μm. For the purpose of ensuring the strength of the granulated particles and generating a reducing gas at the time of sintering, PVA (20% solution) as a binder was added to the slurry in an amount of 1.5% by weight in terms of the solid content of the binder in relation to the weight of the calcined substance (raw material powder); and then the thus treated slurry was granulated and dried with a spray dryer, and the obtained particles (granulated substance) were regulated in particle size. Additionally, together with the binder, a polycarboxylic acid-based dispersant and a polyether-based defoaming agent were added each in a predetermined amount.

The granulated substance obtained as described above was sintered for 30 minutes with a rotary kiln capable of regulating the atmosphere therein to yield a sintered substance. The sintering was performed under the conditions that the temperature was set at 1000° C. and the oxygen concentration was set at 0% by volume by introducing nitrogen gas.

Then, the substance subjected to sintering was disintegrated and further classified for particle size regulation, and subjected to removal of low magnetic strength portions by magnetic separation to yield a core material composed of porous ferrite particles. The pore volume, the peak pore size and the magnetization at $1K \cdot 1000/4\pi \cdot A/m$ of the porous ferrite core material were found to be 0.062 ml/g, 0.45 μm and 52.3 $m^2/kg$, respectively.

Next, 100 parts by weight of the porous ferrite core material was coated with the following resin solution with the aid of a fluidized bed coating apparatus. The resin solution was prepared as follows: 1.8 parts by weight, in terms of solid content, of a condensation cross-linking silicone resin (SR-2411, manufactured by Dow Corning Toray Co., Ltd.), 20% by weight, relative to the resin solid content, of γ-aminopropyltriethoxysilane and 8% by weight, relative to the resin solid content, of carbon black (Ketjen EC) were dispersed in 10 parts by weight of toluene with the aid of a disperser (Ultra-Turrax, manufactured by IKA Inc.); and the resulting dispersion was diluted with toluene so as for the solid content of the resin to be 7.5% by weight, and thus the resin solution was prepared.

After making sure of the sufficient evaporation of the toluene, the mixture was taken out from the stirring-mixing apparatus and transferred into a vessel, and the vessel was placed in a hot air heating oven to perform a heat treatment at 240° C. for 3 hours.

Then, cooling down to room temperature was conducted and the ferrite particles with the cured resin therein were taken out, subjected to disintegration of the particle aggregation with a vibration sieve of 200 M in mesh opening size and subjected to removal of nonmagnetic substances with a magnetic separator, to yield a resin-coated ferrite carrier.

Example 2

A porous ferrite core material was obtained in the same manner as in Example 1 except that the sintering temperature was set at 950° C., and a ferrite carrier was obtained by coating the resulting porous ferrite core material with the resin solution in the same manner as in Example 1.

Example 3

A porous ferrite core material was obtained in the same manner as in Example 1 except that the sintering temperature was set at 1050° C., and a ferrite carrier was obtained by coating the resulting porous ferrite core material with the resin solution in the same manner as in Example 1.

Example 4

A porous ferrite core material was obtained in the same manner as in Example 1 except that a debinder treatment was performed, before sintering, in the air at 650° C. with a rotary kiln to remove organic matter, and a ferrite carrier was obtained by coating the resulting porous ferrite core material with the resin solution in the same manner as in Example 1.

Example 5

A porous ferrite core material was obtained in the same manner as in Example 1 except that the oxygen concentration in the sintering was set at 2% by volume, and a ferrite carrier was obtained by coating the resulting porous ferrite core material with the resin solution in the same manner as in Example 1.

Example 6

A porous ferrite core material was obtained in the same manner as in Example 1 except that 51 mol of $Fe_2O_3$, 16 mol of $Mn_3O_4$, 2 mol of $Mg(OH)_2$ and 0.2 mol of $SrCO_3$ were used, and a ferrite carrier was obtained by coating the resulting porous ferrite core material with the resin solution in the same manner as in Example 1.

Example 7

A porous ferrite core material was obtained in the same manner as in Example 1 except that 58 mol of $Fe_2O_3$, 10 mol of $Mn_3O_4$, 12 mol of $Mg(OH)_2$ and 0.8 mol of $SrCO_3$ were used, and a ferrite carrier was obtained by coating the resulting porous ferrite core material with the resin solution in the same manner as in Example 1.

Example 8

A porous ferrite core material was obtained in the same manner as in Example 1 except that 68 mol of $Fe_2O_3$, 10 mol of $Mn_3O_4$, 2 mol of $Mg(OH)_2$ and 0.8 mol of $SrCO_3$ were used, and a ferrite carrier was obtained by coating the resulting porous ferrite core material with the resin solution in the same manner as in Example 1.

Example 9

A porous ferrite core material was obtained in the same manner as in Example 1 except that 55 mol of $Fe_2O_3$, 12 mol of $Mn_3O_4$, 9 mol of $Mg(OH)_2$ and 1.2 mol of $SrCO_3$ were used, and a ferrite carrier was obtained by coating the resulting porous ferrite core material with the resin solution in the same manner as in Example 1.

Example 10

A porous ferrite core material was obtained in the same manner as in Example 1 except that the addition amount of the binder at the time of the granulation was set at 4.5% by weight, and a ferrite carrier was obtained by coating the resulting porous ferrite core material with the resin solution in the same manner as in Example 1.

Comparative Example 1

A porous ferrite core material was obtained in the same manner as in Example 1 except that the temperature of the sintering was set at 1075° C., and a ferrite carrier was obtained by coating the resulting porous ferrite core material with the resin solution in the same manner as in Example 1.

Comparative Example 2

A porous ferrite core material was obtained in the same manner as in Example 1 except that the temperature of the sintering was set at 900° C., and a ferrite carrier was obtained by coating the resulting porous ferrite core material with the resin solution in the same manner as in Example 1.

Comparative Example 3

A porous ferrite core material was obtained in the same manner as in Example 1 except that the oxygen concentration of the sintering was set at 21% by volume (air), and a ferrite carrier was obtained by coating the resulting porous ferrite core material with the resin solution in the same manner as in Example 1.

Comparative Example 4

A porous ferrite core material was obtained in the same manner as in Example 1 except that the addition amount of the binder at the time of the granulation was set at 0.25% by weight, and a ferrite carrier was obtained by coating the resulting porous ferrite core material with the resin solution in the same manner as in Example 1.

Comparative Example 5

A porous ferrite core material was obtained in the same manner as in Example 1 except that the addition amount of the binder at the time of the granulation was set at 6% by weight, and a ferrite carrier was obtained by coating the resulting porous ferrite core material with the resin solution in the same manner as in Example 1.

Comparative Example 6

A porous ferrite core material was obtained in the same manner as in Example 1 except that 1.5 mol of $SrCO_3$ was used, and a ferrite carrier was obtained by coating the resulting porous ferrite core material with the resin solution in the same manner as in Example 1.

Comparative Example 7

A porous ferrite core material was obtained in the same manner as in Example 1 except that the furnace in the sintering was altered to a pusher-type electric furnace, the sintering temperature was set at 950° C. and the retention time at that temperature was set at 4 hours, and a ferrite carrier was obtained by coating the resulting porous ferrite core material with the resin solution in the same manner as in Example 1.

Comparative Example 8

A porous ferrite core material was obtained in the same manner as in Example 1 except that the furnace in the sintering was altered to a pusher-type electric furnace, the sintering temperature was set at 1050° C. and the retention time at that temperature was set at 4 hours, and a ferrite carrier was obtained by coating the resulting porous ferrite core material with the resin solution in the same manner as in Example 1.

Example 11

A porous ferrite core material was obtained in the same manner as in Example 1, and a ferrite carrier was obtained in the same manner as in Example 1 except that the resulting porous ferrite core material was coated with a resin solution including 3.5 parts by weight, in terms of solid content, of an acryl-modified silicone resin (KR-9706, manufactured by Shin-Etsu Chemical Co., Ltd.) in place of the silicone resin, using a stirring-mixing apparatus at a temperature set at 60° C., in the air while the toluene was being evaporated, and the curing temperature was set at 210° C. and the curing time was set at 2 hours.

Example 12

A porous ferrite core material was obtained in the same manner as in Example 1, and a ferrite carrier was obtained in the same manner as in Example 1 except that the resulting porous ferrite core material was coated with a resin solution including 3.5 parts by weight, in terms of solid content, of an acrylic resin (LR-269, manufactured by Mitsubishi Rayon Co., Ltd.) in place of the silicone resin, by using a stirring-mixing apparatus at a temperature set at 60° C., in the air while the toluene was being evaporated, and the curing temperature was set at 150° C. and the curing time was set at 2 hours.

Example 13

A porous ferrite core material was obtained in the same manner as in Example 1, and the resulting porous ferrite core material was coated with the same resin as in Example 1, by using a stirring-mixing apparatus at a temperature set at 60° C., in the air while the toluene was being evaporated, in an amount of the silicone resin of 5 parts by weight in terms of solid content in relation to 100 parts by weight of the porous ferrite core material, the curing temperature was set at 240° C. and the curing time was set at 3 hours, and thus a ferrite carrier was obtained.

Example 14

A porous ferrite core material was obtained in the same manner as in Example 1, and 100 parts by weight of the porous ferrite core material was coated with the following resin solution with the aid of a fluidized bed coating apparatus. The resin solution was prepared as follows: 1.8 parts by weight, in terms of solid content, of a condensation cross-linking silicone resin (SR-2411, manufactured by Dow Corning Toray Co., Ltd.), 20% by weight, relative to the resin solid content, of γ-aminopropyltriethoxysilane and 15% by weight, relative to the resin solid content, of carbon black (Ketjen EC) were dispersed in 10 parts by weight of toluene with the aid of a disperser (Ultra-Turrax, manufactured by IKA Inc.); and the resulting dispersion was diluted with toluene so as for the solid content of the resin to be 5% by weight, and thus the resin solution was prepared. After the coating, the coated resin was cured at a curing temperature of 240° C. with a curing time of 3 hours to yield a ferrite carrier.

Example 15

A porous ferrite core material was obtained in the same manner as in Example 1, and 100 parts by weight of the porous ferrite core material was coated with the following resin solution with the aid of a fluidized bed coating apparatus. The resin solution was prepared as follows: 0.75 part by weight, in terms of solid content, of a condensation cross-linking silicone resin (SR-2411, manufactured by Dow Corning Toray Co., Ltd.), 5% by weight, relative to the resin solid content, of γ-aminopropyltriethoxysilane and 4% by weight, relative to the resin solid content, of carbon black (Ketjen EC) were dispersed in 10 parts by weight of toluene with the aid of a disperser (Ultra-Turrax, manufactured by IKA Inc.); and the resulting dispersion was diluted with toluene so as for the solid content of the resin to be 7.5% by weight, and thus the resin solution was prepared. After the coating, the coated resin was cured at a curing temperature of 240° C. with a curing time of 3 hours to yield a ferrite carrier.

For each of Examples 1 to 10 and Comparative Examples 1 to 8, Table 1 shows the composition and the calcination conditions (calcination temperature, atmosphere and apparatus), and Table 2 shows the pulverization and granulation conditions, the debinder treatment and the sintering conditions (sintering temperature, atmosphere and apparatus). For each of Examples 1 to 10 and Comparative Examples 1 to 8, Table 3 shows the powder properties (volume average particle size, apparent density, shape factor SF-2, BET specific surface area, pore volume, peak pore size and particle strength) of the porous ferrite core material (core material particle), and Table 4 shows the magnetic properties and the evaluation of the crystallinity, and Table 5 shows the results of the chemical analysis.

For each of the ferrite carriers of Examples 1 to 15 and Comparative Examples 1 to 8, Tables 6 and 7 show the resin coating conditions and Table 8 shows the carrier properties (magnetization, apparent density, volume average particle size, carrier strength and charge amount).

The measurement methods of the strength of each of the core material particles and the strength of each of the resin-coated carriers, and the measurement method of the charge amount are as follows. And, other measurement methods are as described above.

The porous ferrite core material for an electrophotographic developer according to the present invention preferably has a strength of 4% by volume or less.

The strength of the core material exceeding 4% by volume means that the core material particle tends to be cracked. When the core material exceeding 4% by volume is used as the carrier, the cracking and the chipping of the core material occur, the photoreceptor is damaged and such a core material offers causes for image defects such as white spots.

(Strength of Core Material Particle and Strength of Resin-Coated Carrier Strength)

As the apparatuses, the Microtrac Particle Size Analyzer (model 9320-X100) manufactured by Nikkiso Co., Ltd. and the Laser Diffraction Particle Size Distribution Analyzer (Helos System) manufactured by Sympatec Inc. were used, and the strength was defined as (the volume frequency of the particles of 24 μm or less in particle size measured with the Helos System)−(the volume frequency of the particles of 24 μm or less in particle size measured with the Microtrac (Model 9320-X100)). As described above, a comparative measurement of a sample with the Helos System and the Microtrac enables the measurement of the relative strength of a core material particle and the relative strength of a carrier particle. This is because the stress at the time of dispersing a sample in the Helos System is strongly exerted to the sample, hence each of the core material particle and the carrier particle tends to be broken due to stress, and the volume frequency on the smaller particle side in the particle size distribution becomes larger as compared to the case of the measurement of the same sample with the Microtrac; also as compared with a strength measurement method with a small pulverizer such as a sample mill, the measurement methods adopted herein are of course excellent in reproducibility, because of hardly undergoing the effect of the particle size distribution of the sample, and the effect of the number of rotations of the cutter in the sample mill or the effect of the degree of degradation of the cutter in the sample mill.

(Measurement of Charge Amount)

In the measurement concerned, 3 g of a commercially available negatively chargeable toner and 47 g of a carrier were weighed out, and placed in a 50-ml glass bottle, and exposed to a normal temperature-normal humidity environment (N/N environment; room temperature: 25° C., humidity: 55%) for 1 hour. After the exposure, in the normal temperature-normal humidity environment, the contents of the glass bottle was mixed and stirred with the number of rotations of the glass bottle set at 100 rotations; after the elapsed time of 30 min from the start of the stirring, the resulting mixture in the bottle was sampled and the charge amount was measured with a suction-type charge amount measurement apparatus manufactured by Epping GmbH.

TABLE 1

| | Composition (mol) | | | | Calcination conditions | | |
|---|---|---|---|---|---|---|---|
| | $Fe_2O_3$ | $Mn_3O_4$ | $Mg(OH)_2$ | $SrCO_3$ | Temperature (° C.) | Atmosphere | Apparatus |
| Example 1 | 55 | 12 | 9 | 0.8 | 1080 | Air | RK |
| Example 2 | 55 | 12 | 9 | 0.8 | 1080 | Air | RK |
| Example 3 | 55 | 12 | 9 | 0.8 | 1080 | Air | RK |
| Example 4 | 55 | 12 | 9 | 0.8 | 1080 | Air | RK |
| Example 5 | 55 | 12 | 9 | 0.8 | 1080 | Air | RK |
| Example 6 | 51 | 16 | 2 | 0.2 | 1080 | Air | RK |
| Example 7 | 58 | 10 | 12 | 0.8 | 1080 | Air | RK |
| Example 8 | 68 | 10 | 2 | 0.8 | 1080 | Air | RK |
| Example 9 | 55 | 12 | 9 | 1.2 | 1080 | Air | RK |
| Example 10 | 55 | 12 | 9 | 0.8 | 1080 | Air | RK |
| Comparative Example 1 | 55 | 12 | 9 | 0.8 | 1080 | Air | RK |
| Comparative Example 2 | 55 | 12 | 9 | 0.8 | 1080 | Air | RK |
| Comparative Example 3 | 55 | 12 | 9 | 0.8 | 1080 | Air | RK |
| Comparative Example 4 | 55 | 12 | 9 | 0.8 | 1080 | Air | RK |
| Comparative Example 5 | 55 | 12 | 9 | 0.8 | 1080 | Air | RK |
| Comparative Example 6 | 55 | 12 | 9 | 1.5 | 1080 | Air | RK |
| Comparative Example 7 | 55 | 12 | 9 | 0.8 | 1080 | Air | RK |
| Comparative Example 8 | 55 | 12 | 9 | 0.8 | 1080 | Air | RK |

*RK: Abbreviation for rotary kiln

TABLE 2

| | Pulverization/Granulation | | | | | | Debinder treatment | | | Sintering | | |
|---|---|---|---|---|---|---|---|---|---|---|---|---|
| | Apparatus | Slurry particle size (μm) | Slurry viscosity (cps) | Binder (wt %) *1 | Dispersant | Defoaming agent | Temperature (° C.) | Atmosphere | Apparatus | Temperature (° C.) | Oxygen concentration (vol %) | Apparatus |
| Example 1 | Dry pulverization + wet pulverization (bead mill) | 2.14 | 200 | 1.5 | Carboxylic acid-based | Polyether-based | — | — | — | 1000 | 0 | RK |
| Example 2 | Dry pulverization + wet pulverization (bead mill) | 2.26 | 200 | 1.5 | Carboxylic acid-based | Polyether-based | — | — | — | 950 | 0 | RK |
| Example 3 | Dry pulverization + wet pulverization (bead mill) | 2.14 | 200 | 1.5 | Carboxylic acid-based | Polyether-based | — | — | — | 1050 | 0 | RK |
| Example 4 | Dry pulverization + wet pulverization (bead mill) | 2.22 | 200 | 1.5 | Carboxylic acid-based | Polyether-based | 650° C. | Air | RK | 1000 | 0 | RK |
| Example 5 | Dry pulverization + wet pulverization (bead mill) | 2.25 | 200 | 1.5 | Carboxylic acid-based | Polyether-based | — | — | — | 1000 | 2 | RK |

TABLE 2-continued

| | Pulverization/Granulation | | | | | | Debinder treatment | | | Sintering | | |
|---|---|---|---|---|---|---|---|---|---|---|---|---|
| | Apparatus | Slurry particle size (μm) | Slurry viscosity (cps) | Binder (wt %) *1 | Dispersant | Defoaming agent | Temperature (° C.) | Atmosphere | Apparatus | Temperature (° C.) | Oxygen concentration (vol %) | Apparatus |
| Example 6 | Dry pulverization + wet pulverization (bead mill) | 2.09 | 200 | 1.5 | Carboxylic acid-based | Polyether-based | — | — | — | 1000 | 0 | RK |
| Example 7 | Dry pulverization + wet pulverization (bead mill) | 2.14 | 200 | 1.5 | Carboxylic acid-based | Polyether-based | — | — | — | 1000 | 0 | RK |
| Example 8 | Dry pulverization + wet pulverization (bead mill) | 2.24 | 200 | 1.5 | Carboxylic acid-based | Polyether-based | — | — | — | 1000 | 0 | RK |
| Example 9 | Dry pulverization + wet pulverization (bead mill) | 2.19 | 200 | 1.5 | Carboxylic acid-based | Polyether-based | — | — | — | 1000 | 0 | RK |
| Example 10 | Dry pulverization + wet pulverization (bead mill) | 2.24 | 200 | 4.5 | Carboxylic acid-based | Polyether-based | — | — | — | 1000 | 0 | RK |
| Comparative Example 1 | Dry pulverization + wet pulverization (bead mill) | 2.17 | 200 | 1.5 | Carboxylic acid-based | Polyether-based | — | — | — | 1075 | 0 | RK |
| Comparative Example 2 | Dry pulverization + wet pulverization (bead mill) | 2.3 | 200 | 1.5 | Carboxylic acid-based | Polyether-based | — | — | — | 900 | 0 | RK |
| Comparative Example 3 | Dry pulverization + wet pulverization (bead mill) | 2.13 | 200 | 1.5 | Carboxylic acid-based | Polyether-based | — | — | — | 1000 | 21 | RK |
| Comparative Example 4 | Dry pulverization + wet pulverization (bead mill) | 2.1 | 200 | 0.25 | Carboxylic acid-based | Polyether-based | — | — | — | 1000 | 0 | RK |
| Comparative Example 5 | Dry pulverization + wet pulverization (bead mill) | 2.27 | 200 | 6 | Carboxylic acid-based | Polyether-based | — | — | — | 1000 | 0 | RK |
| Comparative Example 6 | Dry pulverization + wet pulverization (bead mill) | 2.18 | 200 | 1.5 | Carboxylic acid-based | Polyether-based | — | — | — | 1000 | 0 | RK |
| Comparative Example 7 | Dry pulverization + wet pulverization (bead mill) | 2.13 | 200 | 1.5 | Carboxylic acid-based | Polyether-based | — | — | — | 950 | 0 | Electric furnace |
| Comparative Example 8 | Dry pulverization + wet pulverization (bead mill) | 2.14 | 200 | 1.5 | Carboxylic acid-based | Polyether-based | — | — | — | 1050 | 0 | Electric furnace |

*1: 10-wt % PVA aqueous solution, amount relative to calcined substance

TABLE 3

| | Powder properties | | | | | | |
|---|---|---|---|---|---|---|---|
| | Volume | | | Surface condition BET | Mercury porosimeter | | |
| | average particle size (μm) | Apparent density (g/cm$^3$) | Shape factor SF-2 | specific surface area (m$^2$/g) | Pore volume (ml/g) | Peak pore size (μm) | Strength Particle strength (vol %) |
| Example 1 | 35.03 | 1.7 | 104 | 0.63 | 0.062 | 0.45 | 2 |
| Example 2 | 35.78 | 1.58 | 102 | 0.95 | 0.085 | 0.51 | 3.1 |
| Example 3 | 35.67 | 1.78 | 108 | 0.42 | 0.052 | 0.31 | 1.7 |
| Example 4 | 35.41 | 1.82 | 103 | 0.48 | 0.048 | 0.3 | 2.4 |
| Example 5 | 35.76 | 1.68 | 107 | 0.58 | 0.064 | 0.41 | 3.8 |
| Example 6 | 35.74 | 1.58 | 108 | 0.71 | 0.068 | 0.37 | 2.4 |
| Example 7 | 35.6 | 1.71 | 103 | 0.57 | 0.057 | 0.48 | 1.7 |
| Example 8 | 35.12 | 1.76 | 102 | 0.47 | 0.05 | 0.29 | 1.3 |
| Example 9 | 35.46 | 1.63 | 107 | 0.61 | 0.06 | 0.42 | 1.9 |
| Example 10 | 35.45 | 1.85 | 106 | 0.46 | 0.053 | 0.32 | 2.8 |
| Comparative Example 1 | 35.89 | 1.93 | 113 | 0.35 | 0.044 | 0.25 | 1.6 |
| Comparative Example 2 | 35.89 | 1.48 | 101 | 1.32 | 0.108 | 0.76 | 5.4 |
| Comparative Example 3 | 35.91 | 1.83 | 113 | 0.39 | 0.045 | 0.42 | 5.1 |
| Comparative Example 4 | 35.24 | 1.79 | 112 | 0.44 | 0.05 | 0.38 | 3.8 |
| Comparative Example 5 | 35.33 | 1.78 | 108 | 0.4 | 0.046 | 0.23 | 5.7 |
| Comparative Example 6 | 35.46 | 1.6 | 114 | 0.76 | 0.071 | 0.52 | 3.6 |
| Comparative Example 7 | 35.27 | 1.51 | 119 | 1.02 | 0.11 | 1.02 | 10.2 |
| Comparative Example 8 | 35.36 | 2.01 | 128 | 0.85 | 0.081 | 1.23 | 3 |

TABLE 4

| | Magnetic properties (VSM, 1K · 1000/4π · A/m) | | | Evaluation of crystallinity based on Raman spectroscopy (Peaks around 600 to 620 cm$^{-1}$) | |
|---|---|---|---|---|---|
| | Magnetization (Am$^2$/kg) | Remanent magnetization (Am$^2$/kg) | Coercive force (A/m) | Full width at half maximum Waverage | Standard deviation of full width at half maximum Wd |
| Example 1 | 52.3 | 3.3 | 34 | 53.08 | 1.27 |
| Example 2 | 49.3 | 4.8 | 45.5 | 54.59 | 2.48 |
| Example 3 | 55.2 | 2.3 | 26.4 | 51.74 | 2.88 |
| Example 4 | 43.1 | 2.8 | 30.1 | 51.03 | 0.91 |
| Example 5 | 45.2 | 3.1 | 32.2 | 52.22 | 1.44 |
| Example 6 | 49.9 | 2.7 | 28.3 | 53.14 | 1.67 |
| Example 7 | 58.1 | 2.9 | 25.9 | 53.35 | 1.56 |
| Example 8 | 57.8 | 3.2 | 34.6 | 53.87 | 1.87 |
| Example 9 | 54.7 | 4.8 | 45.8 | 53.41 | 1.49 |
| Example 10 | 57.6 | 2.5 | 27.9 | 53.97 | 2.23 |
| Comparative Example 1 | 58.1 | 1.9 | 23.9 | 50.87 | 0.76 |
| Comparative Example 2 | 34.6 | 6.5 | 58.8 | 58.22 | 4.56 |
| Comparative Example 3 | 33.1 | 7.2 | 75.4 | 54.23 | 3.27 |
| Comparative Example 4 | 39.5 | 5.9 | 57.2 | 50.51 | 3.16 |
| Comparative Example 5 | 34.3 | 5.5 | 62.7 | 56.82 | 4.31 |
| Comparative Example 6 | 41.7 | 5.1 | 61.2 | 55.01 | 2.61 |
| Comparative Example 7 | 53.6 | 5.1 | 48 | 53.02 | 2.89 |
| Comparative Example 8 | 57.5 | 4.3 | 41.9 | 47.58 | 1.31 |

TABLE 5

| | Chemical analysis (ICP) wt % | | | | Molar ratio Mn/Mg (analysis value) |
|---|---|---|---|---|---|
| | Fe | Mn | Mg | Sr | |
| Example 1 | 52.05 | 16.87 | 1.81 | 0.59 | 4.04 |
| Example 2 | 52.86 | 16.91 | 1.84 | 0.58 | 4.06 |
| Example 3 | 52.36 | 16.86 | 1.81 | 0.59 | 4.08 |
| Example 4 | 52.78 | 16.37 | 1.75 | 0.57 | 4.12 |
| Example 5 | 52.47 | 16.82 | 1.82 | 0.59 | 4.02 |
| Example 6 | 49.08 | 22.65 | 0.36 | 0.14 | 27.11 |
| Example 7 | 54.23 | 13.9 | 2.4 | 0.58 | 2.53 |
| Example 8 | 58.67 | 12.69 | 0.36 | 0.53 | 16.02 |
| Example 9 | 51.82 | 16.8 | 1.84 | 0.88 | 4.06 |
| Example 10 | 52.09 | 16.83 | 1.83 | 0.59 | 4.09 |
| Comparative Example 1 | 53.07 | 16.39 | 1.79 | 0.58 | 4.04 |
| Comparative Example 2 | 52.72 | 16.87 | 1.82 | 0.58 | 4.1 |
| Comparative Example 3 | 53.36 | 15.86 | 1.72 | 0.55 | 4.09 |
| Comparative Example 4 | 52.04 | 16.82 | 1.86 | 0.6 | 4.03 |
| Comparative Example 5 | 52.47 | 16.84 | 1.82 | 0.6 | 4.1 |
| Comparative Example 6 | 51.85 | 16.77 | 1.83 | 1.1 | 4.12 |
| Comparative Example 7 | 53.26 | 16.1 | 1.77 | 0.56 | 4.06 |
| Comparative Example 8 | 53.35 | 16.12 | 1.73 | 0.58 | 4.01 |

TABLE 7

| | Resin coating conditions | | |
|---|---|---|---|
| | Coating apparatus | Curing temperature (° C.) | Curing time (hr) |
| Example 1 | Fluidized bed coating apparatus | 240 | 3 |
| Example 2 | Fluidized bed coating apparatus | 240 | 3 |
| Example 3 | Fluidized bed coating apparatus | 240 | 3 |
| Example 4 | Fluidized bed coating apparatus | 240 | 3 |
| Example 5 | Fluidized bed coating apparatus | 240 | 3 |
| Example 6 | Fluidized bed coating apparatus | 240 | 3 |
| Example 7 | Fluidized bed coating apparatus | 240 | 3 |
| Example 8 | Fluidized bed coating apparatus | 240 | 3 |
| Example 9 | Fluidized bed coating apparatus | 240 | 3 |
| Example 10 | Fluidized bed coating apparatus | 240 | 3 |
| Comparative Example 1 | Fluidized bed coating apparatus | 240 | 3 |
| Comparative Example 2 | Fluidized bed coating apparatus | 240 | 3 |
| Comparative Example 3 | Fluidized bed coating apparatus | 240 | 3 |
| Comparative Example 4 | Fluidized bed coating apparatus | 240 | 3 |

TABLE 6

| | Resin coating conditions | | | | | | | |
|---|---|---|---|---|---|---|---|---|
| | Employed core material particle | Resin | Resin name | Resin coating amount (parts by weight) *2 | Additive (charge control agent) | Addition amount (wt %) *3 | Additive (carbon black) | Addition amount (wt %) *3 |
| Example 1 | Example 1 | Silicone | SR-2411 | 1.8 | γ-Aminopropyltriethoxysilane | 20 | Ketjen EC | 8 |
| Example 2 | Example 2 | Silicone | SR-2411 | 1.8 | γ-Aminopropyltriethoxysilane | 20 | Ketjen EC | 8 |
| Example 3 | Example 3 | Silicone | SR-2411 | 1.8 | γ-Aminopropyltriethoxysilane | 20 | Ketjen EC | 8 |
| Example 4 | Example 4 | Silicone | SR-2411 | 1.8 | γ-Aminopropyltriethoxysilane | 20 | Ketjen EC | 8 |
| Example 5 | Example 5 | Silicone | SR-2411 | 1.8 | γ-Aminopropyltriethoxysilane | 20 | Ketjen EC | 8 |
| Example 6 | Example 6 | Silicone | SR-2411 | 1.8 | γ-Aminopropyltriethoxysilane | 20 | Ketjen EC | 8 |
| Example 7 | Example 7 | Silicone | SR-2411 | 1.8 | γ-Aminopropyltriethoxysilane | 20 | Ketjen EC | 8 |
| Example 8 | Example 8 | Silicone | SR-2411 | 1.8 | γ-Aminopropyltriethoxysilane | 20 | Ketjen EC | 8 |
| Example 9 | Example 9 | Silicone | SR-2411 | 1.8 | γ-Aminopropyltriethoxysilane | 20 | Ketjen EC | 8 |
| Example 10 | Example 10 | Silicone | SR-2411 | 1.8 | γ-Aminopropyltriethoxysilane | 20 | Ketjen EC | 8 |
| Comparative Example 1 | Comparative Example 1 | Silicone | SR-2411 | 1.8 | γ-Aminopropyltriethoxysilane | 20 | Ketjen EC | 8 |
| Comparative Example 2 | Comparative Example 2 | Silicone | SR-2411 | 1.8 | γ-Aminopropyltriethoxysilane | 20 | Ketjen EC | 8 |
| Comparative Example 3 | Comparative Example 3 | Silicone | SR-2411 | 1.8 | γ-Aminopropyltriethoxysilane | 20 | Ketjen EC | 8 |
| Comparative Example 4 | Comparative Example 4 | Silicone | SR-2411 | 1.8 | γ-Aminopropyltriethoxysilane | 20 | Ketjen EC | 8 |
| Comparative Example 5 | Comparative Example 5 | Silicone | SR-2411 | 1.8 | γ-Aminopropyltriethoxysilane | 20 | Ketjen EC | 8 |
| Comparative Example 6 | Comparative Example 6 | Silicone | SR-2411 | 1.8 | γ-Aminopropyltriethoxysilane | 20 | Ketjen EC | 8 |
| Comparative Example 7 | Comparative Example 7 | Silicone | SR-2411 | 1.8 | γ-Aminopropyltriethoxysilane | 20 | Ketjen EC | 8 |
| Comparative Example 8 | Comparative Example 8 | Silicone | SR-2411 | 1.8 | γ-Aminopropyltriethoxysilane | 20 | Ketjen EC | 8 |
| Example 11 | Example 1 | Acryl-modified silicone | KR-9706 | 3.5 | — | — | — | — |
| Example 12 | Example 1 | Acrylic | LR-269 | 3.5 | — | — | — | — |
| Example 13 | Example 1 | Silicone | SR-2411 | 5 | — | — | — | — |
| Example 14 | Example 1 | Silicone | SR-2411 | 1.8 | γ-Aminopropyltriethoxysilane | 20 | Ketjen EC | 15 |
| Example 15 | Example 1 | Silicone | SR-2411 | 0.75 | γ-Aminopropyltriethoxysilane | 5 | Ketjen EC | 4 |

*2: Amount relative to 100 parts by weight of core material

*3: Proportion relative to resin solid content

TABLE 7-continued

| | Resin coating conditions | | |
|---|---|---|---|
| | Coating apparatus | Curing temperature (° C.) | Curing time (hr) |
| Comparative Example 5 | Fluidized bed coating apparatus | 240 | 3 |
| Comparative Example 6 | Fluidized bed coating apparatus | 240 | 3 |
| Comparative Example 7 | Fluidized bed coating apparatus | 240 | 3 |
| Comparative Example 8 | Fluidized bed coating apparatus | 240 | 3 |
| Example 11 | Stirring-mixing apparatus | 210 | 2 |
| Example 12 | Stirring-mixing apparatus | 150 | 2 |
| Example 13 | Stirring-mixing apparatus | 240 | 3 |
| Example 14 | Fluidized bed coating apparatus | 240 | 3 |
| Example 15 | Fluidized bed coating apparatus | 240 | 3 |

TABLE 8

| | Properties of carrier | | | | |
|---|---|---|---|---|---|
| | Magnetization ($Am^2/kg$) | Apparent density ($g/cm^3$) | Volume average particle size (μm) | Carrier strength (vol %) | Charge amount (μC/g) |
| Example 1 | 51.3 | 1.59 | 37.63 | 1.8 | 62.11 |
| Example 2 | 48.5 | 1.52 | 37.25 | 2.9 | 45.3 |
| Example 3 | 54.3 | 1.68 | 37.98 | 1.5 | 74.05 |
| Example 4 | 42.4 | 1.77 | 38.72 | 1.8 | 70.01 |
| Example 5 | 44.2 | 1.6 | 37.78 | 3.4 | 60.16 |
| Example 6 | 48.9 | 1.52 | 37.21 | 2.1 | 56.62 |
| Example 7 | 56.9 | 1.63 | 37.49 | 1.6 | 67.55 |
| Example 8 | 56.7 | 1.65 | 37.68 | 1.2 | 77.01 |
| Example 9 | 53.8 | 1.51 | 38.15 | 1.6 | 64.18 |
| Example 10 | 56.4 | 1.75 | 37.77 | 2.5 | 72.65 |
| Comparative Example 1 | 56.8 | 1.82 | 39.13 | 1.3 | 87.51 |
| Comparative Example 2 | 33.9 | 1.4 | 36.18 | 5.1 | 35.65 |
| Comparative Example 3 | 32.4 | 1.72 | 38.85 | 4.2 | 85.57 |
| Comparative Example 4 | 38.7 | 1.66 | 38.33 | 3.6 | 77.01 |
| Comparative Example 5 | 33.6 | 1.66 | 39.74 | 4.9 | 83.71 |
| Comparative Example 6 | 40.8 | 1.51 | 37.7 | 3.8 | 54.23 |
| Comparative Example 7 | 52.9 | 1.42 | 35.85 | 8.1 | 35 |
| Comparative Example 8 | 56.5 | 1.92 | 36.83 | 2.2 | 47.54 |
| Example 11 | 51 | 1.51 | 38.49 | 1.6 | 74.53 |
| Example 12 | 50.8 | 1.51 | 38.77 | 1.7 | 80.74 |
| Example 13 | 50.3 | 1.52 | 37.49 | 2 | 52.79 |
| Example 14 | 51.5 | 1.53 | 36.86 | 1.7 | 87.44 |
| Example 15 | 52.1 | 1.68 | 36.27 | 1.9 | 47.82 |

From the results shown in Table 3, the following were found. The core material particle obtained in each of Examples 1 to 10 had a low apparent density, but had a small pore size and necessary and sufficient magnetic properties, and was satisfactory as a ferrite carrier core material for an electrophotographic developer. On the other hand, in Comparative Example 1, the sintering temperature was too high, and hence the apparent density was large. In Comparative Example 2, the sintering temperature was too low, and hence the pore volume was large, the pore size was also large and the magnetization was also low. In Comparative Example 3, the sintering was performed in the air, and hence the magnetization was low. In Comparative Example 4, the addition amount of the binder was small, and the sintering was not allowed to proceed sufficiently to decrease the magnetization. In Comparative Example 5, the addition amount of the binder was too large, and hence reduction proceeded at the time of sintering to decrease the magnetization. In Comparative Example 6, the addition amount of Sr was too large, and hence the shape factor SF-2 was large, and the remanent magnetization and the coercive force were too large. In Comparative Example 7, the sintering was performed for a long time by using an electric furnace, but the shape factor SF-2 was large, and the peak pore size and the pore volume were too large. In Comparative Example 8, the sintering was performed for a long time by using an electric furnace, but the apparent density was large and the pore size became too large with the growth of the grains.

From the results shown in Table 8, the following were found. The resin-coated ferrite carrier in each of Examples 1 to 15 had an apparent density, a carrier strength and a charge amount all falling within satisfactory ranges. In contrast to this, the resin-coated ferrite carrier in each of Comparative Examples 1 to 8 was such that at least any of the apparent density, the carrier strength and the charge amount was poor.

The porous ferrite core material for an electrophotographic developer according to the present invention is such that the apparent density is low, the impregnation of a resin into the core material extremely hardly occurs, and the asperities on the surface are small. By using an electrophotographic developer prepared by combining a toner with the resin-coated ferrite carrier prepared by coating with a resin the surface of the porous ferrite core material, the damage to the photoreceptor is reduced, the image defects such as white spots are reduced, the stirring and mixing property of the carrier with the toner is allowed to be excellent because of the lightweight of such a carrier, the damage to the toner is alleviated, and satisfactory images are allowed to be obtained over a long period of time.

Consequently, the present invention can be widely used particularly in the fields of full-color machines required to be high in image quality and high-speed machines required to be satisfactory in the reliability and durability in the image maintenance.

What is claimed is:

1. A porous ferrite core material for an electrophotographic developer comprising:

Mn in an amount of 10 to 25% by weight; Mg in an amount of 0.2 to 3% by weight; Fe in an amount of 48 to 60% by weight; and Sr in an amount of 0.14 to 1% by weight; wherein the porous ferrite core material is formed under conditions that result in an apparent density of 1.5 to 1.9 $g/cm^3$, a shape factor SF-2 of 101 to 110, and a magnetization as measured with a VSM at $1K \cdot 1000/4\pi \cdot A/m$ of 40 to 60 $Am^2/kg$.

2. The porous ferrite core material for an electrophotographic developer according to claim 1, wherein the peak pore size of the porous ferrite core material is 0.25 to 0.6 μm and the pore volume of the porous ferrite core material is 0.045 to 0.09 ml/g.

3. The porous ferrite core material for an electrophotographic developer according to claim 1, wherein the full width at half maximum $W_{average}$ of the peak of the ferrite obtained by Raman spectroscopy in the vicinity of the surface of the porous ferrite core material for an electrophotographic developer is 49 to 56 $cm^{-1}$ and the standard deviation $W_d$ of the full width at half maximum is 3 $cm^{-1}$ or less.

4. A resin-coated ferrite carrier for an electrophotographic developer, wherein the surface of the porous ferrite core material according to claim 1 is coated with a resin.

5. The resin-coated ferrite carrier for an electrophotographic developer according to claim 4, wherein the surface of the porous ferrite core material is coated with 0.5 to 8 parts by weight of a resin in relation to 100 parts by weight of the porous ferrite core material.

6. An electrophotographic developer comprising the resin-coated ferrite carrier according to claim 4 and a toner.

7. The electrophotographic developer according to claim 6, wherein the developer is a refill developer and comprises a toner in an amount of 100 to 3000% by weight with respect to the carrier.

8. An electrophotographic developer comprising a resin-coated ferrite carrier and a toner, wherein the resin-coated carrier comprises a porous ferrite core material, which comprises Mn in an amount of 10 to 25% by weight; Mg in an amount of 0.2 to 3% by weight; Fe in an amount of 48 to 60% by weight; and Sr in an amount of 0.14 to 1% by weight; and has an apparent density of 1.5 to 1.9 g/cm$^3$, a shape factor SF-2 of 101 to 110, and a magnetization as measured with a VSM at $1K \cdot 1000/4\pi \cdot A/m$ of 40 to 60 Am$^2$/kg, and wherein the developer comprises the toner in an amount of 100 to 3000% by weight with respect to the carrier.

* * * * *